US005170021A

United States Patent [19]

Martini

[11] Patent Number: 5,170,021

[45] Date of Patent: Dec. 8, 1992

[54] HYDRAULIC ELEVATOR CONTROL SYSTEM USING A PLURALITY OF SOLENOID VALVES

[75] Inventor: Angelo Martini, Cornaredo, Italy

[73] Assignee: G.M.V. S.r.l., Pero, Italy

[21] Appl. No.: 451,442

[22] Filed: Dec. 15, 1989

[30] Foreign Application Priority Data

Dec. 16, 1988 [EP] European Pat. Off. ..... 88830541

[51] Int. Cl.[5] ..... B66B 9/04

[52] U.S. Cl. ..... 187/110

[58] Field of Search ..... 187/110, 111, 29.2, 187/32, 103, 105, 113, 121

[56] References Cited

U.S. PATENT DOCUMENTS

| | | | |
|---|---|---|---|
| 3,105,573 | 10/1963 | Leveski | 187/111 |
| 4,463,833 | 8/1984 | Ludwig et al. | 187/113 |
| 4,567,411 | 1/1986 | Reimann et al. | 187/103 |
| 4,637,495 | 1/1987 | Blain | 187/111 |
| 4,683,989 | 8/1987 | Pillage et al. | 187/121 |
| 4,715,478 | 12/1987 | Nakamura et al. | 187/111 |
| 4,757,879 | 7/1988 | Rita | 187/32 |
| 4,785,914 | 11/1988 | Blain et al. | 187/105 |
| 4,932,502 | 6/1990 | Blain et al. | 187/111 |

*Primary Examiner*—A. D. Pellinen
*Assistant Examiner*—Lawrence E. Colbert
*Attorney, Agent, or Firm*—Bucknam and Archer

[57] ABSTRACT

Hydraulic elevator system with a hydraulic actuator equipped with a piston, movable in both directions, to raise and lower a cab, a tank of hydraulic fluid and a pump for fluid, a bypass shutter, to control ascent of the piston, and a down shutter to control its descent, a microprocessor for controlling the valves. To compensate variations in load, temperature and pressure of the hydraulic fluid, solenoid valves are provided, driving the shutters, with on/off pulses of variable duration, depending on the information on the behavior and conditions of the system, obtained by feedback of pressure and temperature of the hydraulic fluid and the position and velocity of the elevator car.

7 Claims, 4 Drawing Sheets

HYDRAULIC ELEVATOR CONTROL SYSTEM USING A PLURALITY OF SOLENOID VALVES

FIELD OF THE INVENTION

The present invention relates to a hydraulic elevator system, in particular a system which controls the movement of a hydraulic elevator to keep movement characteristics constant when the parameters of the hydraulic fluid vary, e.g. the pressure and/or viscosity of the fluid and the load transported.

Hydraulic elevators raise and lower the platform or cab by displacements of the end of a movable piston in a hydraulically controlled vertical cylinder.

This type of elevator is used to advantage for lifts to transport persons or goods, as it does not require superelevations, or particular carrying capacities, and consents a more regular movement than conventional lift systems.

DESCRIPTION OF THE PRIOR ART

In these systems, it must, however, be borne in mind that, when the temperature of the fluid vary, and therefore its viscosity and pressure also vary, or the load to be raised or lowered varies, the movement characteristics also generally vary, for example with accelerations and decelerations more or less sudden than those indicated in the characteristic speed diagram.

U.S. Pat. No. 4,715,478 describes a hydraulic elevator in which the movement of the cab is controlled by noting the speed of the latter during acceleration, comparing it with a reference speed memorized to generate a drive signal during deceleration sufficient to keep the movement time constant.

European 227.297 illustrates a hydraulic elevator in which a single valve controlled by a stepper motor is used.

In more diffused, noted versions, two mechanically operated control valves are used, one for the ascent and one for the descent, with internal feedback connections of oleodynamic type, e.g. with small pistons and springs suitably shaped and placed inside the valve body. With these types of valves it is rather complicated to keep the movement characteristics of the system constant with a variation in the pressure and viscosity of the fluid, and variation in the load.

SUMMARY OF THE INVENTION

The object of the invention is to overcome the problems and limitations indicated above, in particular using a standard group of valves controlled by solenoid valves, with hydraulic regulations and of the type normally used on elevator valves. The system uses multiway valves of traditional type, and a power supply (or regulation) of the valves with pulse width modulation (PWM) signals which varies the duration of the opening and closing pulses of the solenoid valves according to the signals received from the feedback sensors.

The invention resides in a hydraulic elevator system comprising:

- a hydraulic actuator equipped with a piston, movable in both directions, to raise and lower a platform;
- a tank of hydraulic liquid;
- a pump for fluid;
- a first slide valve VOB which acts as a by-pass shutter to control piston rise;

- a second slide valve VOD or down shutter valve to control piston descent;
- control means with microprocessor to drive the valves;
- control signal generators connected to control means with microprocessor, capable of emitting pulses of variable duration to drive a first and second solenoid drive valves, associated to each of the by-pass shutter and the second down shutter; and
- sensors of the system and system parameters connected to the control means with microprocessor to vary the duration of the drive pulses.

The invention also resides in a method for controlling the speed of a hydraulic elevator comprising a hydraulic piston equipped with a platform and driven by a hydraulic actuator with two slide valves, to each of which are associated at least two solenoid drive valves, and comprises the following phases:

- detection of the pressure and/or temperature of the hydraulic liquid and the position and speed of the elevator platform;
- processing the data obtained, comparing it with memorized reference values; and
- controlling the solenoid drive valves of the slide valves, during acceleration and deceleration phases, with pulse type wave shapes with constant frequency and pulse duration depending on the differences from the reference values. These and other characteristics and advantages of the invention will be evident from the following description, relating to a preferred but non-limiting embodiment of the invention, and by reference to the drawings in which:

Figure 1:
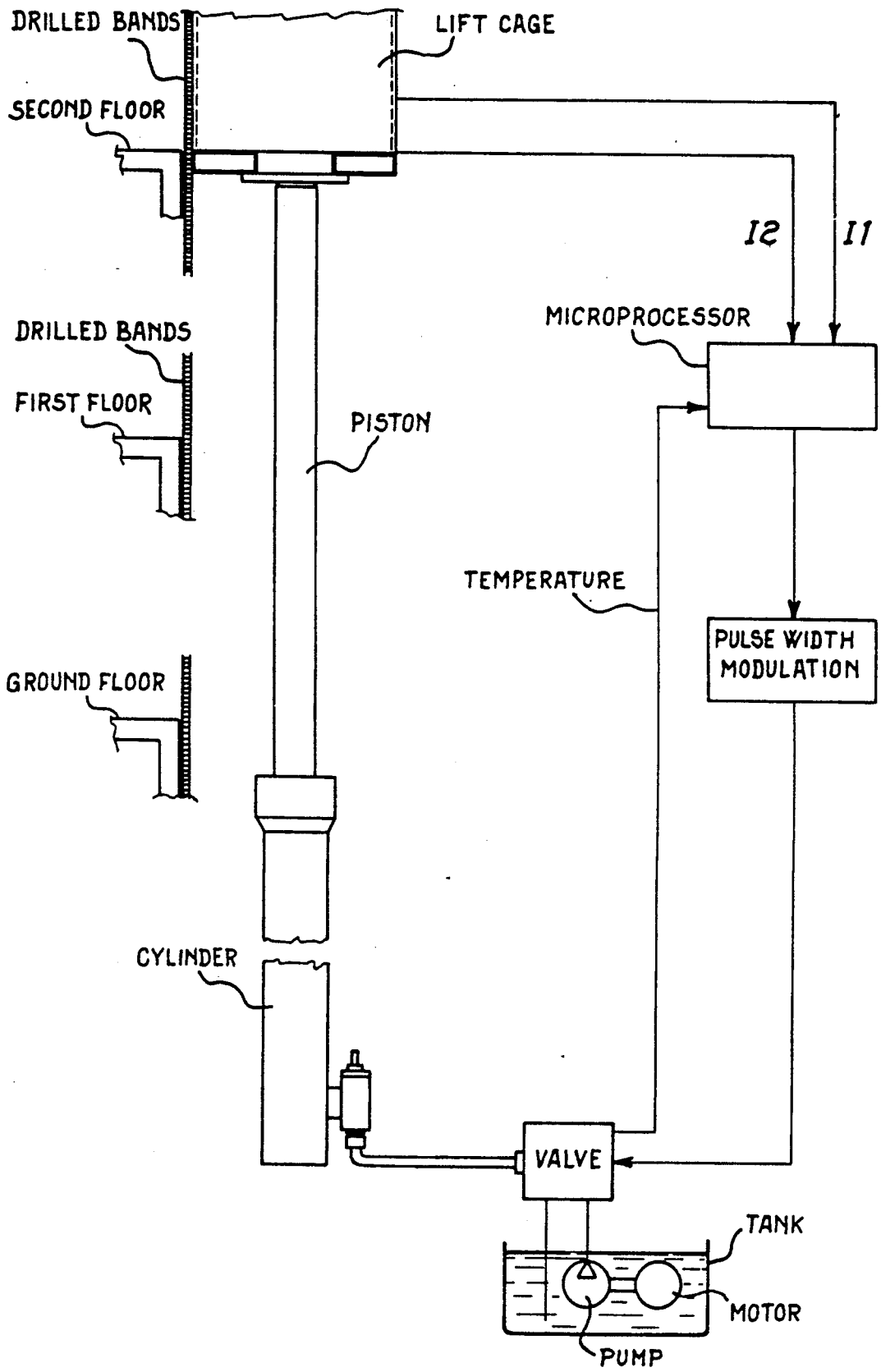
FIG. 1 shows the block diagram of an elevator system incorporating the invention.
Figure 2:
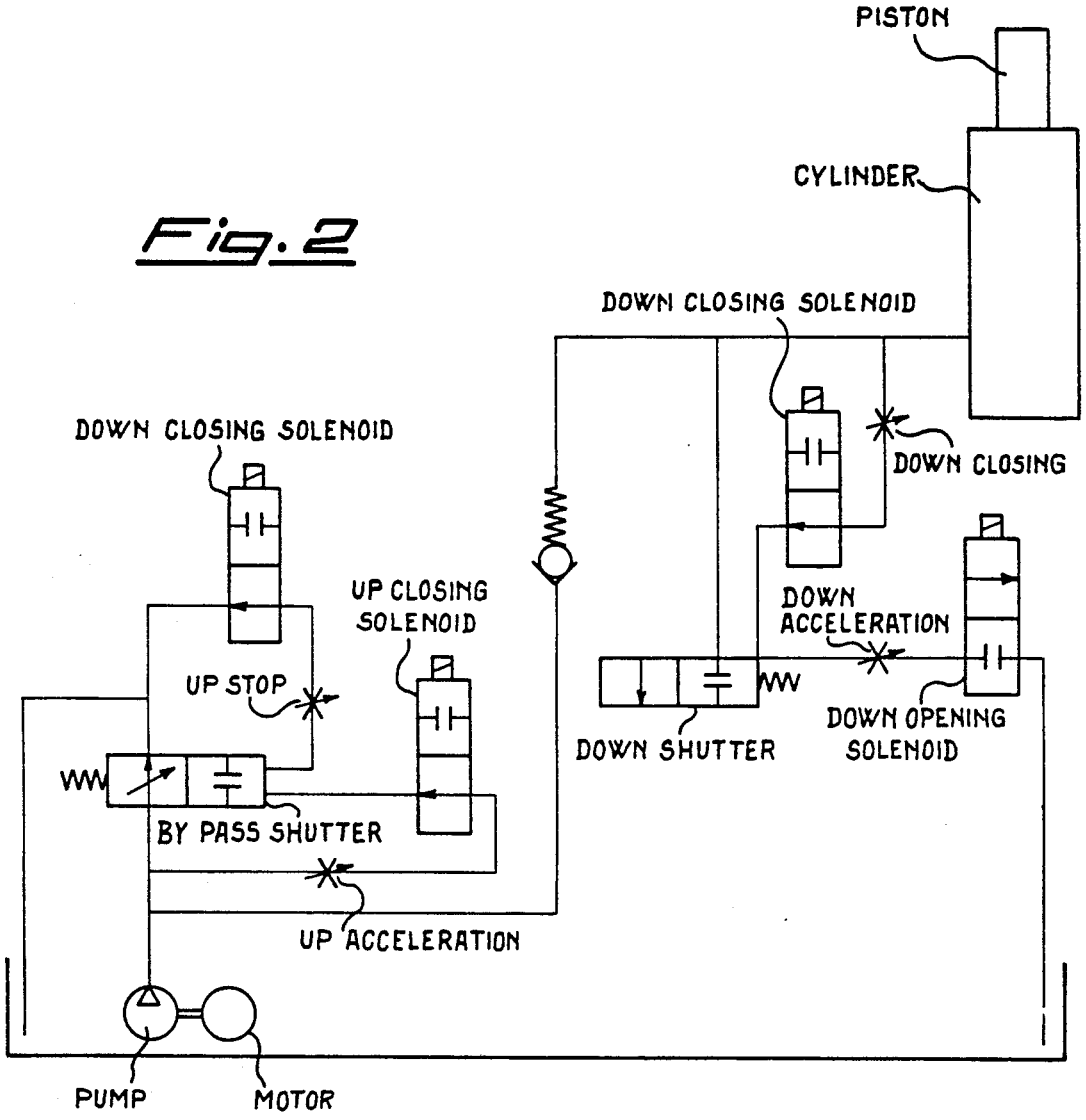
FIG. 2 illustrates a hydraulic diagram of the system shown in FIG. 1.
Figure 3:
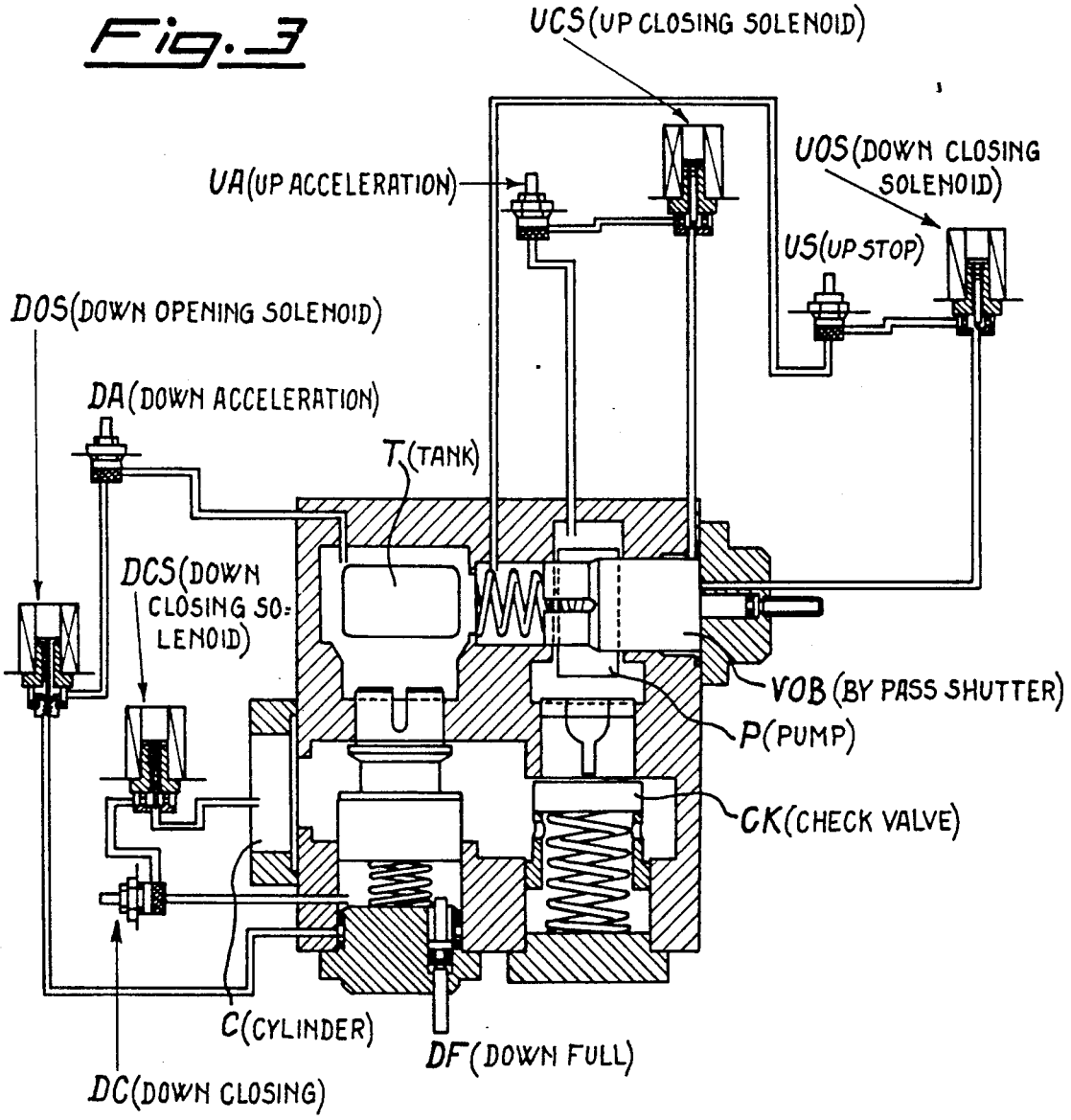
FIG. 3 illustrates a preferred constructive form of the circuit shown in FIG. 2.

The meaning of each symbol shown in FIGS. 1 and 2 is as follows:

| | |
|---|---|
| $FL^0$ = | Ground Floor |
| $FL^1$ = | First Floor |
| $FL^2$ = | Second Floor |
| PT = | Lift cage |
| C = | Cylinder |
| V = | Valve |
| mP = | Microprocessor |
| PWM = | Pulse Width Modulation |
| CK = | Check Valve |
| VOB = | By-pass Shutter (valve) |
| VOD = | Down Shutter (valve) |
| DCS = | Down Closing Solenoid |
| DOS = | Down Opening Solenoid |
| UCS = | Up Closing Solenoid |
| UOS = | Down Closing Solenoid |
| P = | Pump |
| UA = | Up Acceleration |
| DA = | Down Acceleration |
| UC = | Up Closing |
| DC = | Down Closing |
| T = | Tank |
| DF = | Down Full (speed) |
| US = | Up Stop |

DESCRIPTION OF THE PREFERRED EMBODIMENT

With reference to FIG. 1, the elevator system according to the invention comprises a cylinder C with vertical axis in which is movable a piston P1 to which is associated a lift cage or platform PT, directly, or through a system of cables and pulleys which consents a cab displacement, equal, in general, to the ratio of piston travel, e.g. 2:1, 4:1, 4:2 etc.

The cylinder C is fed with a fluid, oil in particular, coming from a tank T and pressurized by a pump P driven by motor M. A valve, indicated with V, regulates the flow of oil to the cylinder and its flow from the cylinder in the up and down phases of the cab PT, on command of a control device with microprocessor mP, which also controls a unit PWM generating drive pulses whose duration is variable on microprocessor control.

The control device receives, among other things, information on the parameters of the hydraulic system, like the temperature of the oil, schematically indicated by the symbol S, which influences the viscosity characteristics of this latter, and the pressure. These parameters are indicated as system parameters.

The microprocessor device also receives information on the speed and position of the cab, illustrated by symbols 11, 12, obtained in various ways. For example, in FIG. 1 are shown drilled bands BF at the floors FL0–FL2, astride of the floor threshold, which interact with a photo-electric cell system (not shown) generating electric pulses the number of which represents the position of the cab, while their repeating frequency gives an indication of cab speed. This information is representative of the system parameters. The operation of the system will now be described with reference to FIGS. 2 and 4.

Figure 4:
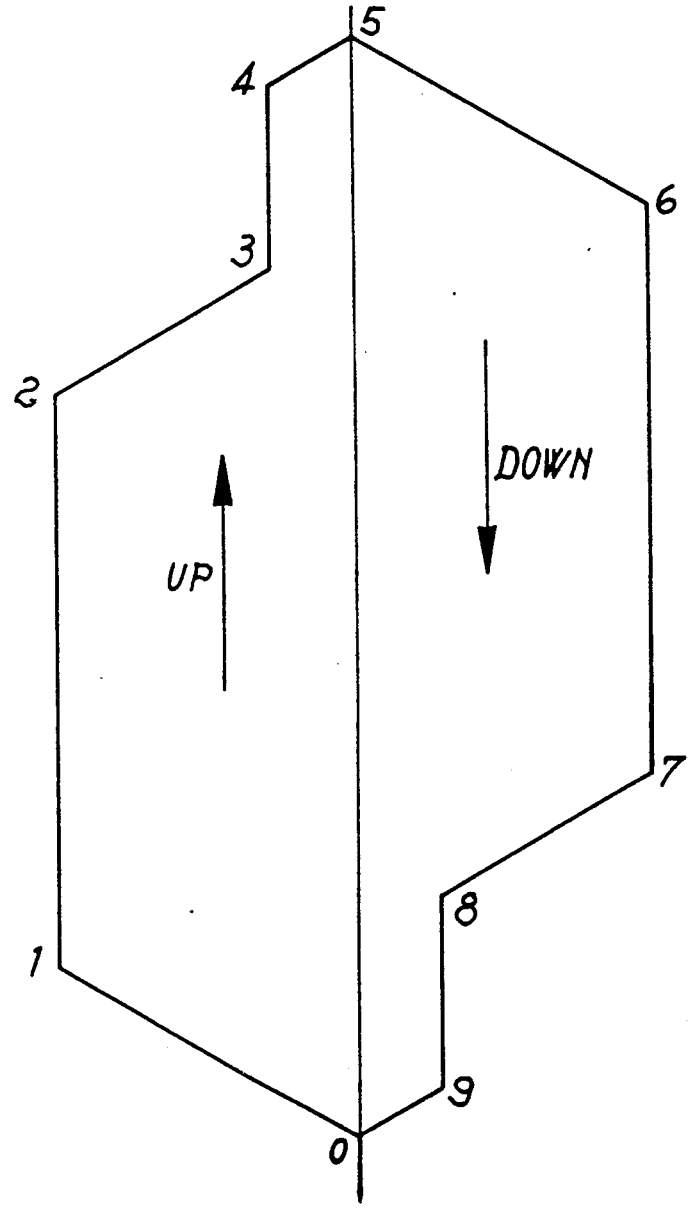
FIG. 4 shows a speed/time diagram of the movement of the platform.

FIG. 4 shows first of all a diagram representing cab speed as a function of time, both in ascent and descent. During ascent, represented by the arrow UP, the cab is initially accelerated at running speed, designated by section 0–1, also called high speed.

The movement then continues with this first speed practically constant (section 1–2) with which the greatest part of lifting height is covered. FIG. 1 illustrates the situation of a system with two floors plus the ground floor, at any rate with a different number of floor, only the length of the sections covered at the high speed changes.

In section 2–3, large-small transition, near the floor of arrival, speed is reduced to a second practically constant value (3–4), of small upward speed, at which a brief section is covered before final deceleration 4–5 which ends with stop at the cab floor.

The DOWN diagram is similar, but with speed directed downwards, and comprises a section of down acceleration (5–6), of high speed (6–7), a large-small transition (7–8), a small down speed (8–9) and a final stopping deceleration (9–0).

These diagrams should be valid in any working condition, but, in reality, when the temperature and viscosity of the oil and the load, vary, the cab speed follows diagrams which, although with the same departure and arrival points, differ from those foreseen. For example, a greater oil viscosity causes a lower acceleration and therefore extends the duration on the time axis of section 0–1, etc.

Referring to FIG. 2, in the system according to the invention two slide valves are provided, a first valve to control the up phases called bypass shutter VOB, and a second valve VOD to control the down phases, called down shutter valve. The two valves operate separately, and each of them is driven by two solenoid valves, one for opening, the other for closing.

To the valve VOB are associated a first closing solenoid valve UCS and a second opening solenoid valve UOS, while to the valve VOD are associated a first closing solenoid valve DCS and a second opening solenoid valve DOS.

In point 0 of the diagram, as the solenoid valve UCS is not excited, the oil sent by the solenoid valve UCS to the valve VOB goes to discharge. A check valve CK on the main oil duct prevents reflux from the cylinder C.

During the up acceleration section 0–1, the oil must be inserted with rising flow rate in the cylinder C by closure of the valve VOB. For this purpose only one solenoid valve, or both solenoid valves, are continuously opened and closed by a control signal of the type PWM (pulse-duration modulation) produced by the microprocessor, taking into account the feedback signals received through suitable sensors of the pressure and/or temperature of the oil. The microprocessor mP is capable of varying the duration of the opening and closing pulses sent to the solenoid valves, thus suitably dosing the quantity of oil which passes into the necks and keeping the acceleration characteristics of the system practically constant. The solenoid valves are fed with pulses for the entire duration of acceleration phase 0–1, until the bypass shutter VOB is complete closed. In constant speed section 1–2, the bypass shutter VOB remains complete closed and the check valve CK remains open, so that all the oil goes to the cylinder C. The solenoid valve UCS is normally open, so that the pressurized oil coming from the pump P keeps the bypass shutter VOB closed, while the solenoid valve UOS continues to remain excited preventing the oil going to discharge.

In the large-small transition of section 2–3, the bypass shutter VOB must gradually return to an opening position to which the passage of a certain (smaller than section 1–2) constant flow of oil to the cylinder corresponds. Partial opening of VOB is obtained by means of the pulse control of the solenoid valves. Also during this transition, the microprocessor controls the emission of drive signals by the unit PWM, keeping the transition characteristics of the system practically constant.

Small up section 3–4 takes place at reduced speed kept constant due to the information supplied by the cab feedback and, to keep the bypass shutter VOB in the required position, both solenoid valves UCS and UOS are suitably driven.

Finally, the stop phase 4–5 corresponds to a large-small transition up to zero speed and is obtained driving the solenoid valves with pulses until the bypass shutter VOB opens completely, deviating all the oil towards discharge. In point 5 the down shutter VOD and check valve CK keep the system stopped at the floor. When not excited the solenoid valve DCS permits oil to pass from the section in pressure to the shutter chamber, while the solenoid valve DOS prevents this oil going to discharge unless there is a precise excitation (opening) control.

In down acceleration section 5–6, the down shutter VOD is opened according to a pre-established rule, supplying the solenoid valves with pulses, discharging the oil with flow rate rising to point 6. The information that the required speed has been reached is supplied by the cab feedback. During this phase as for the up transitions, it is possible to control the variations of the conditions of the system adapting the outputs of the unit PWM of the solenoid valves. High speed section 6–7 takes place with the solenoid valve excited and the solenoid valve DOS not excited, to maintain the down shutter VOD in the maximum opening position. As DCS is closed, oil does not arrive to close the shutter and oil cannot be discharged to open the switch through DOS. Wlith the speed and/or position feedback, it is thus possible, with the unit PWM, to make the necessary speed corrections.

In the large-small transition 7–8, the closing shutter VOD is partially closed to decelerate the system, controlling with on/off cycles the solenoid valves to keep the transition characteristics of the system practically constant. Small downstroke phase 8–9 is carried out keeping the down shutter VOD at a standstill, suitably driving the solenoid valves DCS and DOS.

Finally, a few centimeters from the floor, complete closure of the shutter VOD and stop in point 0 is controlled. FIG. 2 shows a constructive version of valve V, with the four solenoid control valves and four throttle valves DA, DC, UA and UC on the ducts of the solenoid valves, to regulate the maximum and minimum values of the system. The hydraulic regulations to the valve are thus made in nominal pressure and temperature conditions, setting regulations UA and DA for acceleration and UC and US for deceleration. These values are then maintained substantially constant at the variation of the pressure and/or temperature and load, modifying the drive signals PMW of the solenoid valves. Although the invention has been described with particular reference to a preferred constructive form, it should not be considered limiting, but its field of protection extends to all the obvious modifications and/or variations defined in the claims.

I claim:

1. A hydraulic elevator system comprising:

a hydraulic actuator having a cylinder (C) with a vertical axis equipped with a piston (P1) movable in both directions to raise and lower a lift cage (PT);

a tank (T) of hydraulic fluid;

a pump (P) for the hydraulic flud driven by a motor adapted to feed said hydraulic fluid to said cylinder, a first valve (V) regulating the flow to said cylinder of said hydraulic fluid;

a by-pass shutter valve (VOB) to control the ascent of the piston (P1);

a down shutter valve (VOD) to control the descent of the piston (P1);

first control microprocessor means (mP) to drive said by-pass shutter valve and said down shutter valve (VOB, VOD);

control signal generator (PWM) connected to said microprocessor means, capable of emitting pulses of variable duration, said by-pass shutter valve (VOB) and said down shutter valve (VOD) being connected to said control signal generator (PWM);

a first closing solenoid valve (UCS) and a second opening solenoid valve (UOS) being connected to said bypass shutter valve (VOB);

first closing solenoid valve (DCS) and a second opening solenoid valve (DOS) being connected to the down shutter valve (VOD);

sensors of pressure and temperature of the hydraulic fluid (S) and the position and velocity of the platform connected to said first control microprocessor means (mP) to vary the duration of pulses of the opening and closing pulses sent to said solenoid valves according to the signals received from said sensors.

2. The elevator system according to claim 1 wherein said first (UCS) and second (UOS) solenoid valves of said by-pass shutter valve (VOB) control the open and closing of said pulses.

3. The elevator system according to claim 1 wherein said first (DCS) and second (DOS) solenoid valves of said down shutter (VOD) control the opening and closing of pulses fed to said solenoid valves.

4. A method of controlling the speed of a hydraulic elevator which comprises a hydraulic actuator having a cylinder equipped with a piston (P1) movable in both directions to raise and lower a lift cage (PT), a bypass shutter valve (VOB) and a down shutter valve (VOD), solenoid valves being associated to each of said bypass shutter valves (UCS and UOS), and said down shutter valves (DCS and DOS), a tank of hydraulic fluid, which consists of the steps of detecting the pressure and temperature of said hydraulic fluid and detecting the position and speed of said platform, processing the data obtained, comparing said data with memorized reference data, controlling said solenoid valves (UCS, UOS, DCS, DOS), during the acceleration and deceleration phases, with pulse type wave shapes with constant frequency and pulse duration depending on the differences from the reference values.

5. The method according to claim 4, wherein during acceleration phase only one or both solenoid valves of the pair of solenoid valves associated to each of said by-pass shutter valves and down shutter valve are continuously opened and closed by a control signal of the PWM type.

6. The method according to claim 4 wherein during the acceleration phase hydraulic fluid is fed to said cylinder until said by-pass shutter valve (VOB) is closed.

7. The method according to claim 4 wherein during the deceleration phase said second slide valve (VOD) is partially closed.

* * * * *